US010077676B2

(12) United States Patent
Shteyman et al.

(10) Patent No.: US 10,077,676 B2
(45) Date of Patent: Sep. 18, 2018

(54) TURBINE EXHAUST CYLINDER/TURBINE EXHAUST MANIFOLD BOLTED FULL SPAN TURBINE EXHAUST FLAPS

(71) Applicant: Siemens Energy, Inc., Orlando, FL (US)

(72) Inventors: Yevgeniy P. Shteyman, West Palm Beach, FL (US); John Giaimo, Palm Beach Gardens, FL (US); Randy Tindell, Delray Beach, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 426 days.

(21) Appl. No.: 14/945,857

(22) Filed: Nov. 19, 2015

(65) Prior Publication Data

US 2016/0208642 A1 Jul. 21, 2016

Related U.S. Application Data

(60) Provisional application No. 62/104,255, filed on Jan. 16, 2015.

(51) Int. Cl.

| | |
|---|---|
| ***F01D 25/26*** | (2006.01) |
| ***F01D 25/04*** | (2006.01) |
| ***F01D 9/06*** | (2006.01) |
| *F01D 25/30* | (2006.01) |
| *F01D 25/28* | (2006.01) |

(52) U.S. Cl.

CPC ..... *F01D 25/04* (2013.01); *F01D 9/065* (2013.01); *F01D 25/26* (2013.01); *F01D 25/28* (2013.01); *F01D 25/30* (2013.01); *F05D 2260/31* (2013.01)

(58) Field of Classification Search

CPC ..... F01D 25/04; F01D 9/065; F01D 25/30; F01D 25/24; F01D 25/28; F01D 9/041; F01D 5/145; F01D 5/146; F01D 25/26; F01D 17/14; F01D 17/12; F05D 2260/31; F02C 7/20; F02K 1/44; F02K 1/40; F02K 1/42; F02K 1/52

See application file for complete search history.

(56) References Cited

U.S. PATENT DOCUMENTS

| | | | | |
|---|---|---|---|---|
| 4,993,918 A * | 2/1991 | Myers | F01D 9/065 415/191 |
| 5,451,116 A * | 9/1995 | Czachor | F01D 9/065 403/28 |
| 5,672,047 A * | 9/1997 | Birkholz | F01D 9/065 415/160 |

(Continued)

*Primary Examiner* — Eldon Brockman

(57) ABSTRACT

A system and method to minimize flow induced vibration in a gas turbine exhaust is provided. The system includes a turbine exhaust manifold connected to a turbine exhaust cylinder establishing a fluid flow path, the fluid flow path bounded radially outward by an outer cylindrical surface and bounded radially inward by an inner cylindrical surface. At least one tangential strut is arranged between the outer cylindrical surface and the inner cylindrical surface. A trailing edge full span flap is removable secured behind the trailing edge of the tangential strut in a fluid flow direction and extending between the outer cylindrical surface and the inner cylindrical surface where the full span flap minimizes vortex shedding of the fluid flow from the tangential strut.

18 Claims, 5 Drawing Sheets

(56) References Cited

U.S. PATENT DOCUMENTS

| | | | | |
|---|---|---|---|---|
| 5,851,105 | A * | 12/1998 | Fric | F01D 25/162 415/208.1 |
| 6,068,213 | A * | 5/2000 | Gonidec | F02K 1/52 244/53 B |
| 6,619,916 | B1 * | 9/2003 | Capozzi | F01D 5/148 415/160 |
| 6,792,758 | B2 * | 9/2004 | Dowman | F01D 17/162 415/142 |
| 7,410,343 | B2 * | 8/2008 | Wakazono | F01D 25/162 415/208.1 |
| 8,099,962 | B2 * | 1/2012 | Durocher | F01D 9/065 415/126 |
| 8,713,909 | B2 * | 5/2014 | Cunha | F01D 5/187 60/204 |
| 2003/0161724 | A1 * | 8/2003 | Capozzi | F01D 5/148 415/161 |
| 2004/0088989 | A1 * | 5/2004 | Dowman | F01D 17/162 60/772 |
| 2010/0132372 | A1 * | 6/2010 | Durocher | F01D 9/065 60/796 |
| 2017/0130610 | A1 * | 5/2017 | Nanda | F01D 5/145 |

* cited by examiner

TURBINE EXHAUST CYLINDER/TURBINE EXHAUST MANIFOLD BOLTED FULL SPAN TURBINE EXHAUST FLAPS

This application claims the benefit of priority under U.S. Provisional Application No. 62/104,255, filed Jan. 16, 2015 and entitled "Turbine Exhaust Cylinder/Turbine Exhaust Manifold Bolted Full Span Turbine Exhaust Flaps", which is incorporated by reference herein.

BACKGROUND

1. Field

The present application relates to gas turbines, and more particularly to a system and method to minimize flow induced vibration in a gas turbine exhaust system.

2. Description of the Related Art

The turbine exhaust cylinder and the turbine exhaust manifold are coaxial gas turbine casing components connected together establishing a fluid flow path for the gas turbine exhaust. The fluid flow path includes an inner flow path and an outer flow path defined by an inner diameter delimiting an outer cylindrical surface of the inner flow path and an outer diameter delimiting an inner cylindrical surface of the outer flow path, respectively. Tangential struts are arranged within the fluid flow path and serve several purposes such as supporting the flow path and providing lubrication for the turbine and rotor bearing. At certain conditions, the exhaust flow around the tangential struts can cause vibrations of the inner and outer diameter of the turbine exhaust cylinder and the turbine exhaust manifold due to vortex shedding. Vortex shedding is an unsteady flow phenomenon typically caused by high incidence on the tangential struts. It may cause large oscillations in flowpath pressures that force the flowpath structure to vibrate or even resonate strongly. These vibrations are a potential contributor to damage occurring on the flow path of the turbine exhaust manifold and the turbine exhaust cylinder. This damage to the casing components may require replacement or repair.

SUMMARY

Briefly described, aspects of the present disclosure relates to a system to minimize flow induced vibration in a gas turbine exhaust and a method to minimize flow induced vibration in a flow path of a gas turbine exhaust.

A first aspect of provides a system to minimize flow induced vibration in a gas turbine exhaust. The system includes a turbine exhaust manifold connected to a turbine exhaust cylinder establishing a fluid flow path, the fluid flow path bounded radially outward by an outer cylindrical surface and bounded radially in ward by an inner cylindrical surface. At least one tangential strut is arranged between the outer cylindrical surface and the inner cylindrical surface. A trailing edge full span flap is removably secured behind the trailing edged of the tangential strut in a fluid flow direction and extends between the outer cylindrical surface and the inner cylindrical surface. The full span flap is configured to minimize vortex shedding of the fluid flow from the tangential strut.

A second aspect of provides a method to minimize flow induced vibration in a gas turbine exhaust system. The method includes disposing a full span flap between an outer cylindrical surface and an inner cylindrical surface of the fluid flow path and removably securing the full span flap behind a trailing edge of a tangential strut by coupling the full span flap to the outer cylindrical surface and the inner cylindrical surface flexible attachment brackets. The flow path is bounded radially outward by an outer cylindrical surface and bounded radially inward by an inner cylindrical surface. The full span flap is configured to minimize vortex shedding of the fluid flow from the tangential strut.

DETAILED DESCRIPTION

To facilitate an understanding of embodiments, principles, and features of the present disclosure, they are explained hereinafter with reference to implementation in illustrative embodiments. Embodiments of the present disclosure, however, are not limited to use in the described systems or methods.

The components and materials described hereinafter as making up the various embodiments are intended to be illustrative and not restrictive. Many suitable components and materials that would perform the same or a similar function as the materials described herein are intended to be embraced within the scope of embodiments of the present disclosure.

Damage to gas turbine casing components is an issue that may be caused by vibrations within the inner and outer flow path of the gas turbine exhaust system. In particular, vibrations such as panel modes and/or critical modes may be flow induced vibrations excited by vortex shedding from the tangential struts. Panel modes are mode shapes of panels. In structural dynamics, mode shapes are three-dimensional deformation shapes of an elastic component. Critical modes are mode shapes that couple with the forcing function or energy input and are especially problematic because they may create damage to the casing components, particularly to the flow path of the gas turbine.

An approach to avoid component damage to the casing components caused by vibrations would be to introduce a full span flap removably secured behind the turbine exhaust cylinder and/or turbine exhaust manifold tangential struts to mitigate the vortex shedding from the tangential struts. The full span flaps each extend from the outer cylindrical surface to the inner cylindrical surface and are used to minimize the flow induced vibrations in the gas turbine exhaust. The installation of the full span flap may be accomplished in a reasonable time frame, for example, within 24 hours. Additionally, the attachment scheme of the full span flaps within the gas turbine exhaust system does not damage or reconfigure the existing hardware such that the full span flaps may be removed when desired.

Figure 1:
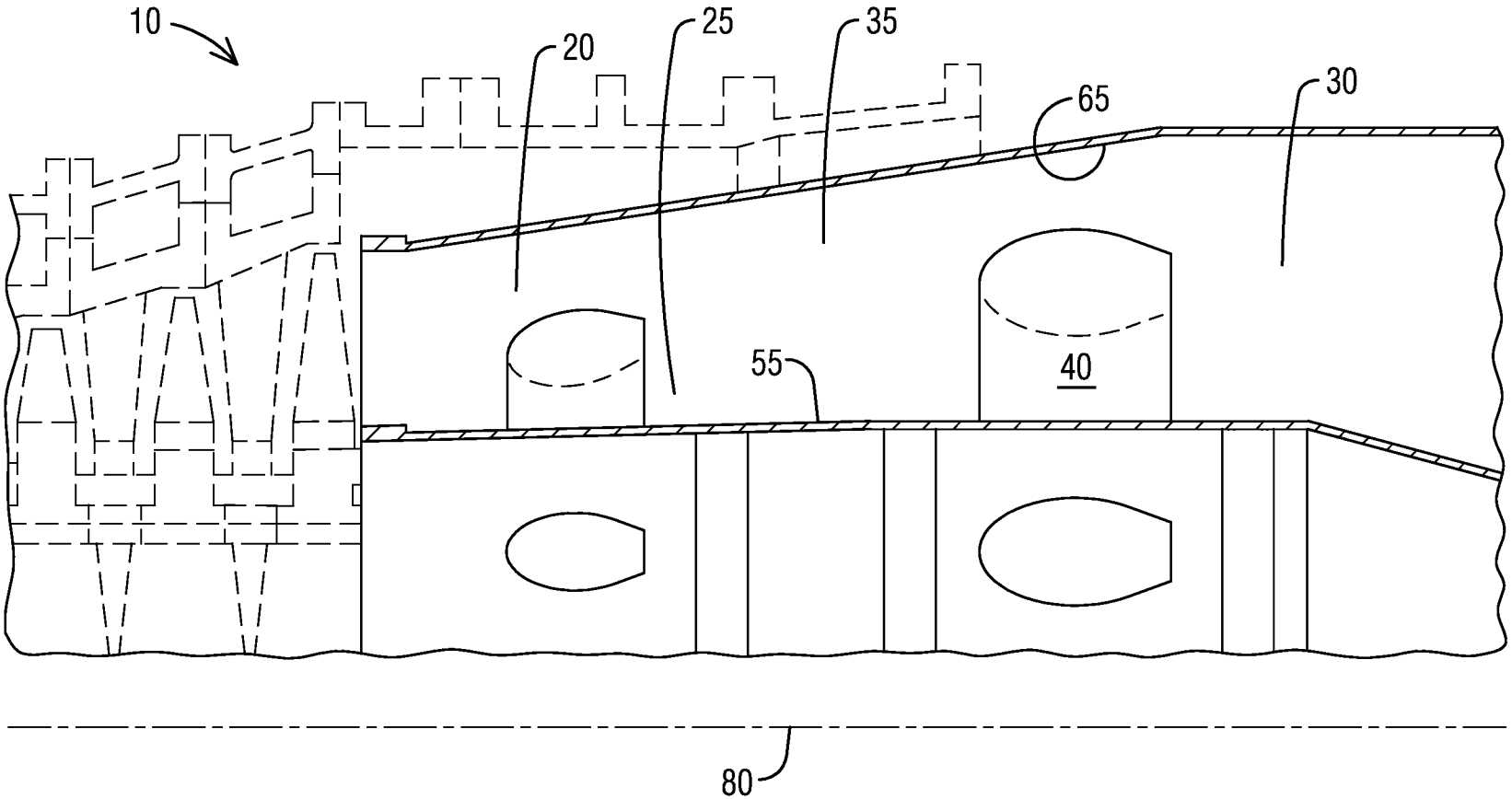
FIG. 1 . . . illustrates a longitudinal view of the exhaust system of a gas turbine, FIG. 2 . . . illustrates a longitudinal view of the exhaust system a gas turbine including a trailing edge full span flap, FIG. 3*a* . . . illustrates a perspective view of a trailing edge full span flap, FIG. 3*b* . . . illustrates a cross section of the trailing edge full span flap according to section A-A, FIG. 4*a* . . . illustrates a perspective view of a trailing edge full span flap with a flexible attachment brackets, FIG. 4*a* . . . illustrates a zoomed in view of the flexible attachment bracket attached to the trailing edge full span flap, FIG. 5 . . . illustrates a radial cross sectional view of the attachment of the flexible attachment bracket to the full span flap, FIG. 6 . . . illustrates a nut plate including a groove, and FIG. 7 . . . illustrates a flexible attachment bracket attached to the inner cylindrical surface/outer cylindrical surface using a spherical joint.

FIG. 1 illustrates a longitudinal view of the exhaust system (10) of a gas turbine. The turbine exhaust system (10) is disposed in the aft portion of the turbine section of the gas turbine and includes a turbine exhaust cylinder (20) and a turbine exhaust manifold (30). The turbine exhaust manifold (30) is connected downstream from the turbine exhaust cylinder (20) and establishes a fluid flow path, the fluid flow path includes an inner flow path (25) and outer flow path (35). The fluid flow path is bounded radially inward by an inner cylindrical surface (55) and radially outward by an outer cylindrical surface (65) with respect to a rotor centerline (80). Struts (40) are hollow tubes that may extend between the inner flow path (25) to the outer flow path (35).

Figure 2:
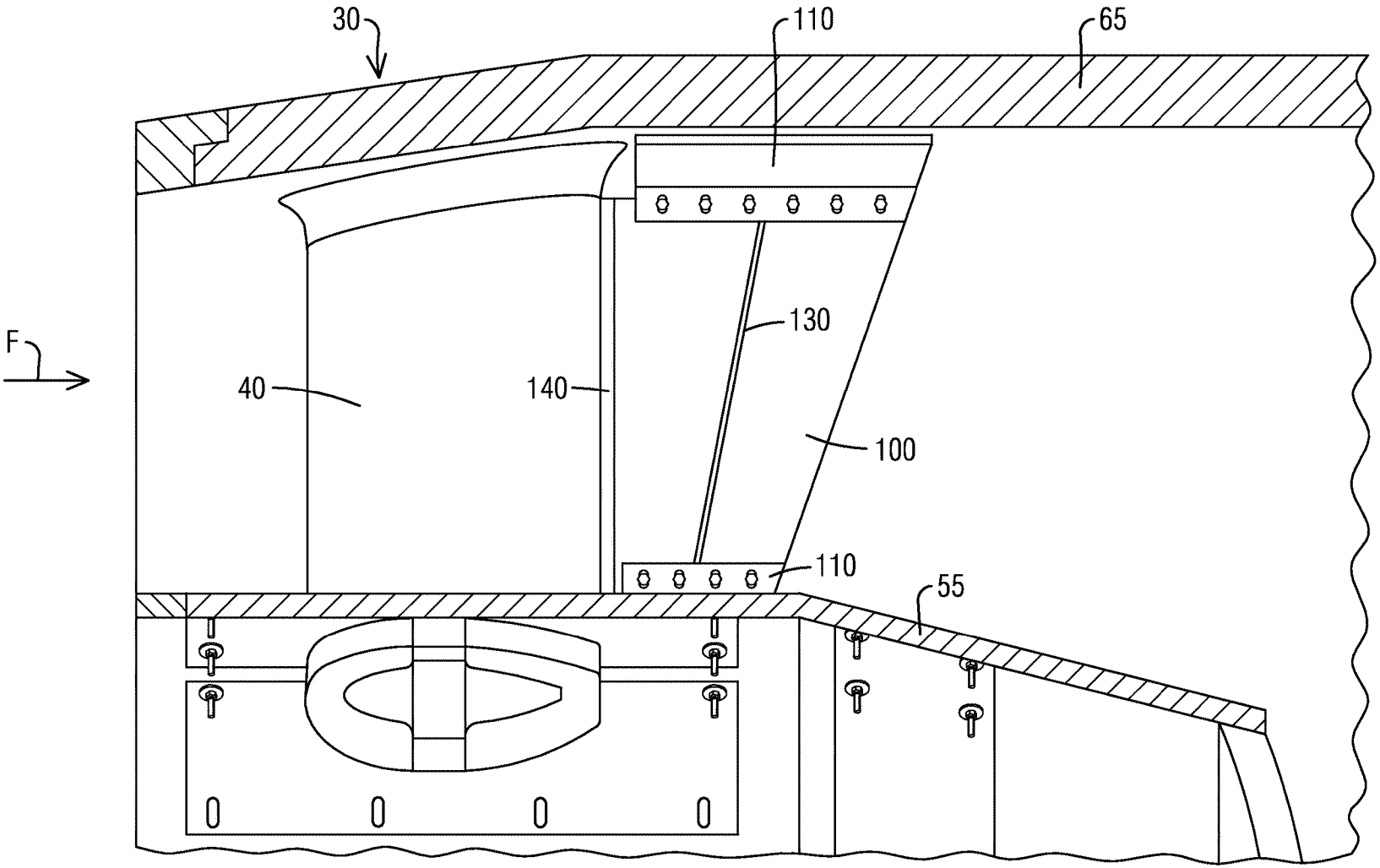

FIG. 2 illustrates a longitudinal view of the turbine exhaust manifold (30) including a full span flap (100) removably secured behind the trailing edge of the tangential strut (40) in a fluid flow direction (F). In the shown embodiment, the full span flap (100) is arranged between the inner cylindrical surface (55) and the outer cylindrical surface (65) of the flow path. Secured flexible attachment brackets (110) attach the full span flap (100) to the outer cylindrical surface (65) and the inner cylindrical surface. A plate (140) may be disposed between the trailing edge full span flap (100) and the tangential strut (40) in order to fill a gap between the two, however, the full span flap (100) may not be attached to the plate (140) or the tangential strut (40) in any way. A stiffening rib (130) may be centrally disposed within the full span flap (100).

Figure 3A:
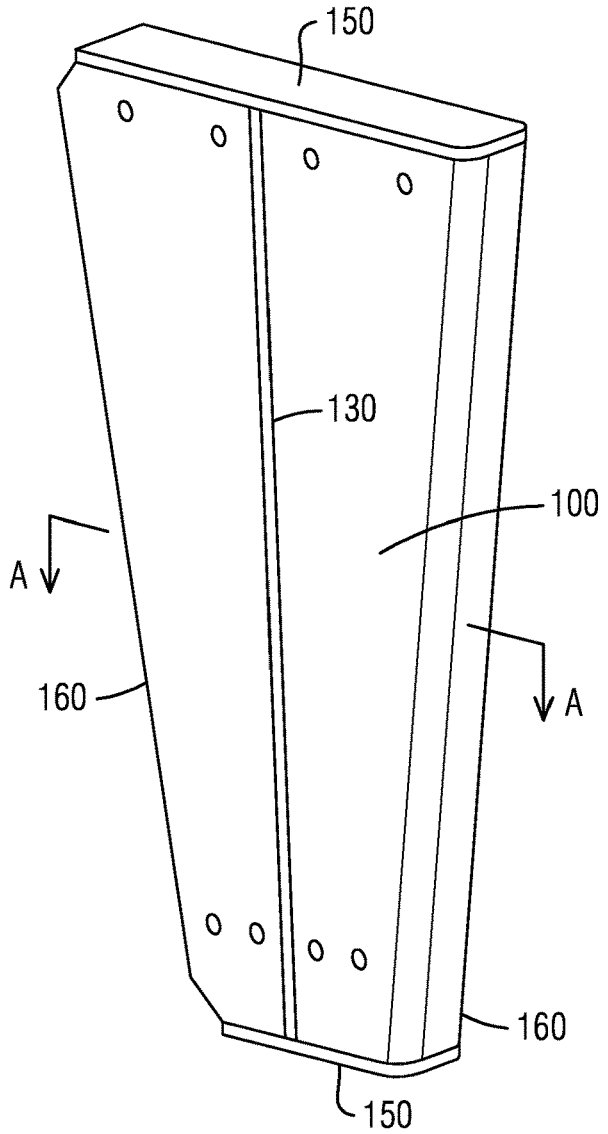
Figure 3B:
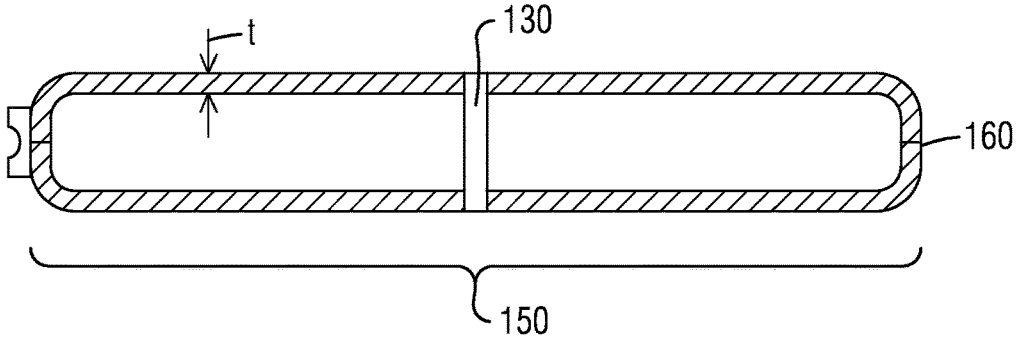

FIGS. 3*a* and 3*b* illustrate the geometry of a full span flap (100). FIG. 3*a* includes a perspective view of the full span flap (100) and FIG. 3*b* includes a cross sectional view of the full span flap (100) according to the section A-A in FIG. 3*a*. The full span flap (100) geometry may include the shape of a hollow rectangular box including two radial edges (150) and two axial edges (160). The hollowness of the full span flap allows the frequency of the full span flap (100) to be tailored to avoid the inner and outer cylindrical panel mode natural frequencies and the excitation frequencies of the flow induced vibrations. The radial edges (160) extend radially, with respect to a rotor centreline (80), from the outer cylindrical surface (65) to the inner cylindrical surface (55) and may be rounded in order to promote a smooth aerodynamic fluid flow. The rounded radial edges (160) may be seen in the cross sectional view of FIG. 3*b* which displays a cross section of the full span flap (100) in a racetrack shape. The axial edges (150) of the full span flap (100) may extend axially, with respect to the rotor centreline (80), along the inner cylindrical surface (55) and the outer cylindrical surface (65). The wall thickness (t) of the hollow rectangular box shape may lie in a range from ¼" to ½" in.

In an embodiment, a first axial edge (150) extending axially along the outer cylindrical surface (65) is longer than a second axial edge (150) extending along the inner cylindrical surface (55). As a result of the turbine exit aerodynamic profile and computational fluid dynamics which predicts that larger fluid flow separation occurs at the outer cylindrical surface (65), more vortex shedding occurs at the outer cylindrical surface (65). In order to mitigate this more pronounced vortex shedding, the first axial edge (150) along the outer cylindrical surface (65) is longer than the second axial edge (150) extending along the inner cylindrical surface (55).

Additionally, a stiffening rib (130) may be disposed centrally within the hollow rectangular box extending radially from the inner cylindrical surface (55) to the outer cylindrical surface (65) as shown in the illustrated embodiment. The stiffening rib (130) is effective to increase the stiffness of the hollow rectangular box shape. This stiffness may contribute to the overall robustness of the full span flap (100) and allows the frequency of the full span flap (100) to be tailored to avoid the inner and outer cylindrical panel mode natural frequency and the excitation frequencies of the flow induced vibrations.

Each of the components within the fluid flow path of the turbine exhaust cylinder/turbine exhaust manifold (20, 30) may have a different thermal mass with the result that these components thermally grow, i.e. contract or expand, differently. For example, the turbine exhaust manifold (30) may heat up slower in response to the heated fluid flow within the flow path than the full span flap (100) due to its greater thermal mass. Thus, the attachment of the full span flap (100) should be flexible enough to accommodate the differential thermal growth of the flow path components while keeping the joint between the full span flap (100) and the inner cylindrical surface (55) and/or the full span flap (100) and the outer cylindrical surface (65) tight. An attachment scheme for the above criteria may be accomplished using secured flexible attachment brackets (110) such that the axial edges (150) are slideably attached to the outer cylindrical surface (65) and/or inner cylindrical surface (55).

Figure 4A:
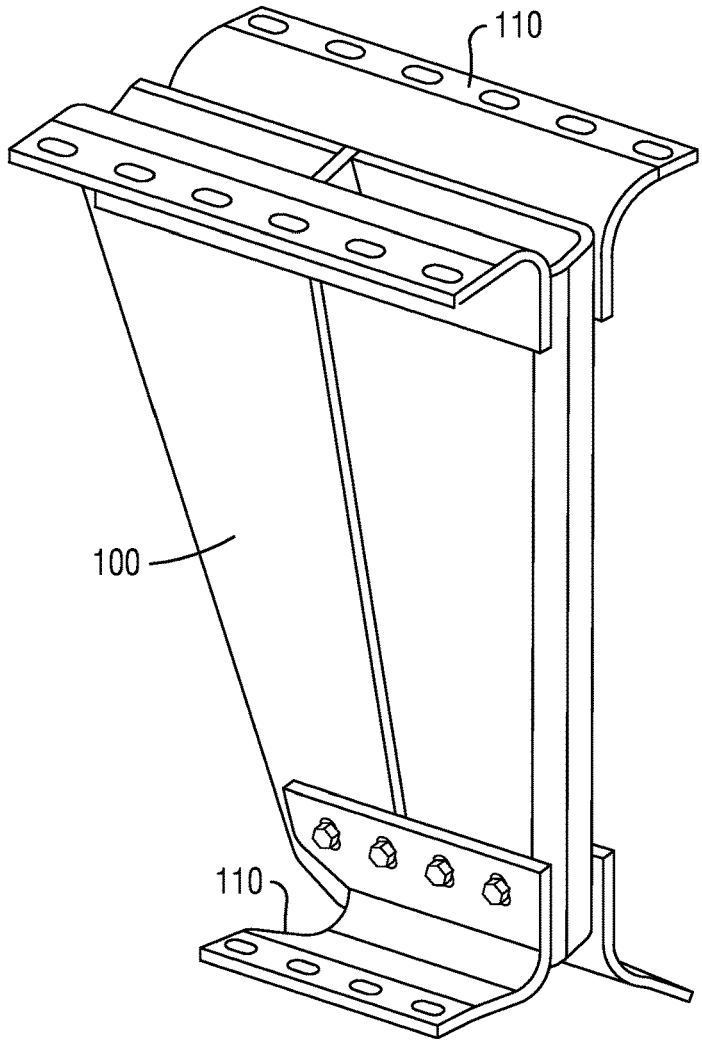
Figure 4B:
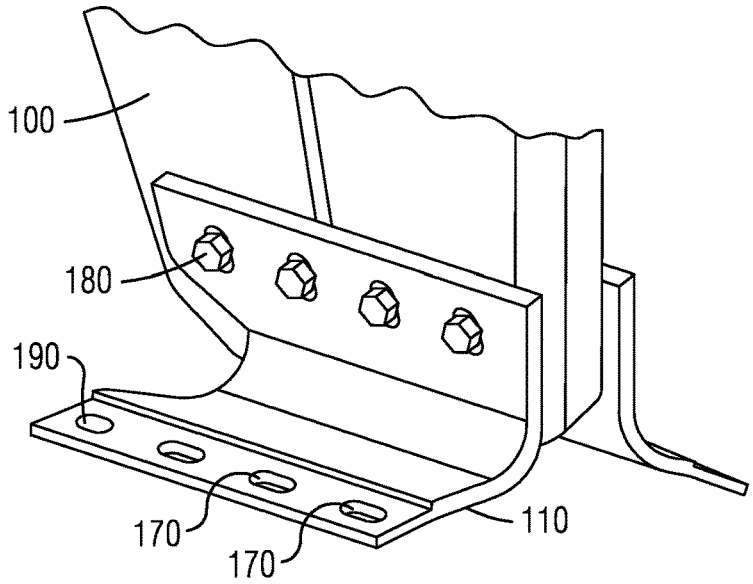

FIGS. 4*a* and 4*b* illustrate the full span flap (100) with flexible attachment brackets (110). The flexible attachment brackets may be arcuate flexible attachment brackets as shown. The flexible attachment brackets (110) attach the full span flap (100) to the inner cylindrical surface (55) and also may attach the full span flap (100) to the outer cylindrical surface (65). Two flexible attachment brackets (110) may be used, one fastened on each side of the axial edge (150), to couple the full span flap (100) to the inner cylindrical surface (55) or the outer cylindrical surface (65). Each flexible attachment bracket (110) may include two interfaces, an interface with the full span flap (100) and an interface with the inner cylindrical surface (55) or to the outer cylindrical surface (65). Each interface may include a set of elongated holes (170) fastened to either the full span flap (100) or the inner cylindrical surface (55) or the outer cylindrical surface (65) with a fastener (180). For example, bolts may be used as the fastener (180), as illustrated in FIG. 4*b*. However, one skilled in the art would understand that other fasteners may also be used. This bolted flexible attachment scheme allows the full span flap (100) to axially slide along the inner cylindrical surface (55) and allows the full span flap to slide axially along the outer cylindrical surface (65) in order to accommodate the differential thermal growth between the full span flap (100) and the turbine exhaust manifold/turbine exhaust cylinder (30, 20) as previously discussed.

As may be seen in FIG. 4*b*, the flexible attachment bracket (110) may include two sets of elongated holes (170), through which fasteners (180) would be inserted and secured in order to attach the full span flap (100) to the inner cylindrical surface (55) and/or the outer cylindrical surface (65). The fastener (180) may be inserted through the first set of elongated holes (170) and secured attaching the flexible attachment bracket (110) to the inner cylindrical surface (55). Additionally, the fastener may be inserted through the first set of elongated holes (170) and secured attaching the flexible attachment bracket (110) to the outer cylindrical surface (65). Similarly, fasteners (180) may be inserted through the second set of elongated holes (170) and secured attaching the flexible attachment bracket (110) to the full span flap (100).

Each elongated hole (170) may be racetrack shaped such that two sides of the elongated hole (170) are flat and parallel to one another connected by two curved sides. A first set of elongated holes (170) may have the parallel sides parallel to the axial edge (150) of the full span flap (100) and another set of elongated holes (170) may have the parallel sides parallel to the radial edge (160) of the full span flap (100).

The plurality of fasteners (180) slide within the elongated hole (170) during turbine operation to accommodate the differential thermal growth of the full span flap (100), the outer cylindrical surface (65), and the inner cylindrical surface (55). The second set of elongated holes (170) may additionally enable correct positioning of the full span flap (100) within the fluid flow path by allowing for vertical adjustability of the full span flap (100). A smaller elongated hole (190) may be provided in the first set of elongated holes (170) and configured such that a corresponding fastener (180) would not be permitted to slide within the smaller elongated hole (190). The smaller elongated hole (190) would provide a positioning reference point for the attached full span flap (100) along the inner cylindrical surface (55) or outer cylindrical surface (65). Consequently, the sliding of the full span flap (100) due to the differential thermal growth will occur away from this positioning reference point.

Figure 6:
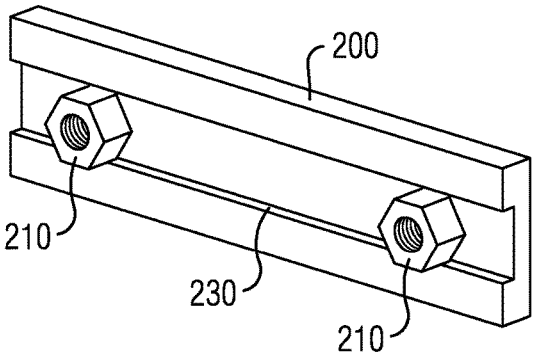
Figure 5:
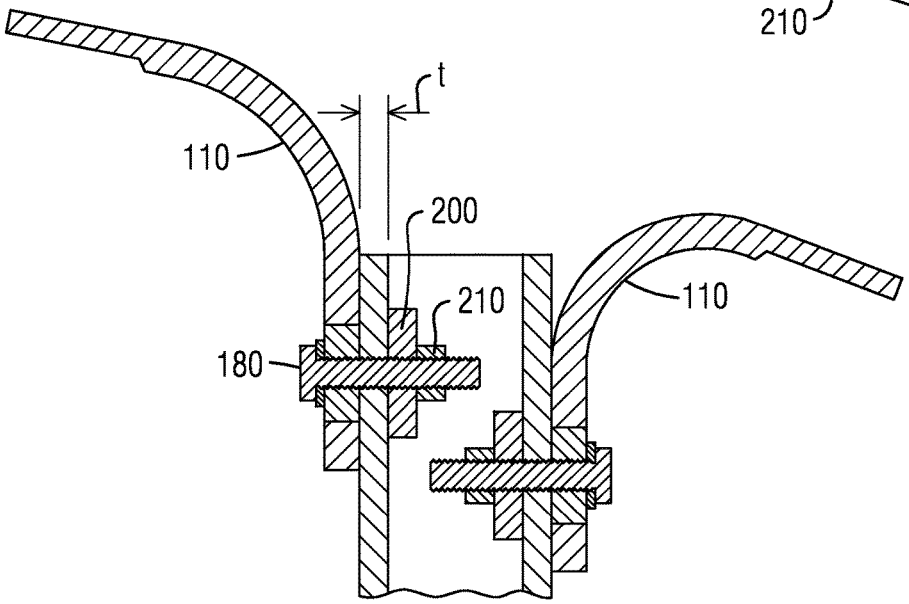

As mentioned previously, each flexible attachment bracket (110) may include two interfaces, an interface with the full span flap (100) and an interface with the inner cylindrical surface (55) or the outer cylindrical surface (65). FIG. 5 illustrates a radial cross sectional view of the attachment of flexible attachment brackets (110) attached to the full span flap (100). In order to attach the flexible attachment bracket (110) to the full span flap (100), the fastener (180) may inserted through the elongated hole (170) in the flexible attachment bracket (110), through a corresponding hole in the wall thickness (t) of the full span flap (100), and then through a corresponding hole in the nut plate (200). The nut plate (200) may welded to the interior wall of the full span flap (100). Securing means (210), for example a nut, may be used to secure the fastener (180) to the nut plate (200). Additionally, the securing means (210) may be welded to the nut plate (200). A fairly tight clearance exists between interior walls of the full span flaps (100), for example between 50 and 80 mm, with the result that manually tightening the fasteners (180) may be difficult. In an embodiment as illustrated in FIG. 6, a groove (230) may be disposed in the nut plate (200) such that the nut (210) fits within the groove (230) preventing an antirotation of the nut (210).

Figure 7:
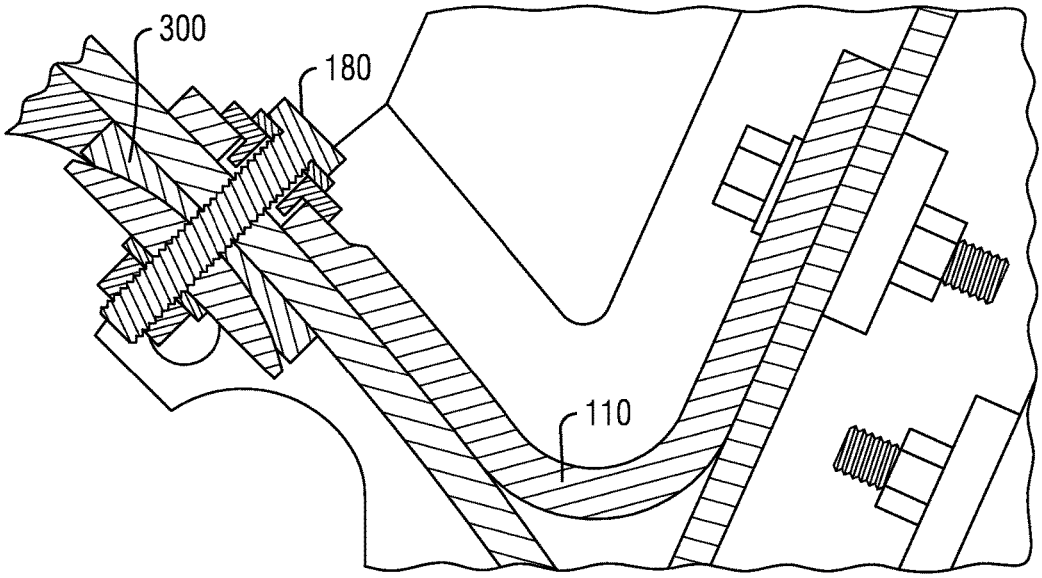

Each flexible attachment bracket (110) also includes an interface with the inner cylindrical surface (55) or the outer cylindrical surface (65). In one embodiment, the flexible attachment bracket (110) may be attached to the inner cylindrical surface (55) or the outer cylindrical (65) in a similar manner as the attachment of the flexible attachment bracket (110) to the full span flap (100), described in the previous paragraph. However, in another embodiment the flexible attachment bracket (110) may be attached to the inner cylindrical surface (55) or outer cylindrical surface (65) using a spherical joint (300) as illustrated in FIG. 7.

Due to the high temperatures of the fluid flow through the turbine exhaust cylinder (20)/turbine exhaust manifold (30) the inner cylindrical surface (55)/the outer cylindrical surface (65) may become excessively distorted. Because of this excessive distortion, the elongated hole (170) of the flexible attachment bracket (110), the hole in the inner cylindrical surface/outer cylindrical surface, and the hole in the nut plate (200) may be misaligned such that the fastener (180) may not be able to be positioned normally to the inner cylindrical/outer cylindrical surface (55,65). In order to accommodate this misalignment caused by the inner/outer cylindrical surface distortion, the nut plate (200) may be embodied as a spherical joint comprising, for example, two plates with rounded, spherical surfaces, that fit together as shown in FIG. 7.

Referring to FIGS. 1-7, a method to minimize flow induced vibration in a flow path of a gas turbine exhaust system (10) is also provided. In an embodiment, a full span flap (100) is disposed between an outer cylindrical surface (65) and an inner cylindrical surface (55) of the flow path and positioned behind the trailing edge of the tangential strut (40). The full span flap (100) may then be removably secured to the outer cylindrical surface (65) and the inner cylindrical surface (55) by coupling the full span flap (100) to the outer cylindrical surface (65) and the inner cylindrical surface (55) using a plurality of flexible attachment brackets (110).

As shown in FIGS. 3*a* and 3*b* and mentioned previously, the geometry of the full span flap (100) may include a hollow rectangular box shape, with two radial edges (160) that extend radially with respect to the rotor centerline (80) from the inner cylindrical surface (55) to the outer cylindrical surface (65). Additionally, two axial edges (150) may be provided that extend axially with respect to the rotor centerline (80) along the outer cylindrical surface (65) or the inner cylindrical surface (55). The radial edges (160) may be rounded to promote a smooth aerodynamic fluid flow in the turbine exhaust system (10).

As illustrated in FIG. 4*a* through FIG. 6, the full span flap (100) may be removably secured behind the tangential strut (40) by inserting a plurality of fasteners (180) through a plurality of corresponding elongated holes (170) within the flexible attachment brackets (110) and securing the full span flap (100) to the inner surface of the flow path. A first set of fasteners (180) attaches the flexible attachment bracket (110) to the full span flap (100) and a second set of fasteners (180) attaches the flexible attachment bracket (110) to the outer cylindrical surface (65) or the inner cylindrical surface (55).

The fasteners (180) may be secured to a nut plate (200, 300) on an opposing surface of the full span flap (100). The fasteners may also be secured to a nut plate (200, 300) on an opposing surface of the inner cylindrical surface (55) or the outer cylindrical surface (65) using a securing means (210). The nut plate (200, 300) may be welded to the opposing surface. Furthermore, the securing means (210) may also be welded to the plate (200).

In order to attach the flexible attachment bracket (110) to the inner cylindrical surface (55) or the outer cylindrical surface (65), the nut plate (210) may be embodied as a spherical joint (300) such that two spherical plates (300) fit together. The spherical plates (300) may move relative to one another to accommodate thermal distortion of the inner cylindrical surface/outer cylindrical surface so that the fastener (180) may be positioned normally to the fluid flow path.

The plurality of elongated holes (170) permit each of the plurality of fasteners (180) to slide within the elongated hole (170), hence allowing the full span flap (100) to slide along the fluid flow path, in order to accommodate the differential thermal growth of the full span flap (100), the outer cylindrical surface (65), and the inner cylindrical surface (55).

In summary, the full span flap (100) removably attached behind the trailing edge of a tangential strut (40) provides a way to effectively eliminate vortex shedding in the critical areas of the turbine exhaust flow around the tangential strut (40). The flexible attachment bracket (110) with its attachment scheme accommodates the differential radial and axial thermal growth of the individual components within the fluid flow path. Additionally, the stiffening rib (130) provides the full span flap (100) with a mechanical robustness to endure the harshness of the environment within the turbine exhaust manifold/turbine exhaust cylinder (20, 30). The attachment scheme of the flexible attachment bracket (110) to the inner cylindrical surface (55) and/or outer cylindrical surface (65) incorporates features that allow for distortion in the turbine exhaust manifold/turbine exhaust cylinder (20, 30) and production tolerances in the radial distance between the inner cylindrical surface (55) and the outer cylindrical surface (65). Thus, full span flap (100) configuration is a versatile option that may be easily installed in a new engine or retrofitted on an existing engine.

While embodiments of the present disclosure have been disclosed in exemplary forms, it will be apparent to those skilled in the art that many modifications, additions, and deletions can be made therein without departing from the spirit and scope of the invention and its equivalents, as set forth in the following claims.

What is claimed is:

1. A system to minimize flow induced vibration in a gas turbine exhaust, comprising:

a turbine exhaust manifold connected to a turbine exhaust cylinder establishing a fluid flow path, the fluid flow path bounded radially outward by an outer cylindrical surface and bounded radially inward by an inner cylindrical surface;

a tangential strut arranged between the outer cylindrical surface and the inner cylindrical surface; and a trailing edge full span flap removably secured behind a trailing edge of the tangential stmt in a fluid flow direction and extending between the outer cylindrical surface and the inner cylindrical surface, wherein the full span flap is configured to minimize vortex shedding of the fluid flow from the tangential strut, wherein the trailing edge full span flap includes a hollow rectangular box shape including two radial edges and two axial edges, and wherein the radial edges, extending radially with respect to a rotor centerline, of the trailing edge full span flap are rounded to promote a smooth aerodynamic fluid flow.

2. The system as claimed in claim 1, wherein within the hollow rectangular box shape a radially extending stiffening rib is disposed.

3. The system as claimed in claim 1, wherein the trailing edge full span flap includes a first axial edge and a second axial edge, the first axial edge extending axially with respect to the rotor centerline along the outer cylindrical surface and the second axial edge extending axially with respect to the rotor centerline along the inner cylindrical surface, and wherein the first axial edge is longer than the second axial edge.

4. The system as claimed in claim 3, wherein the first and second axial edges are slideably attached to the outer cylindrical surface and the inner cylindrical surface, respectively.

5. The system as claimed 4, wherein the first and second axial edges are slideably attached to the outer cylindrical surface and the inner cylindrical surface, respectively, using a flexible attachment bracket.

6. The system as claimed in claim 5, wherein the flexible attachment bracket includes a plurality of elongated holes, a first plurality of elongated holes and a second plurality of elongated holes through which a plurality of corresponding fasteners are inserted and secured in order to attach the full span flap to the outer cylindrical surface or the inner cylindrical surface.

7. The system as claimed in claim 6, wherein a first plurality of fasteners are each inserted through the first plurality of elongated holes, through a hole in the wall thickness of the full span flap and through a hole in a nut plate, wherein each fastener of the first plurality of fasteners is secured to the nut plate with a securing means.

8. The system as claimed in claim 7, wherein the nut plate includes a groove such that the securing means is prevented from antirotating.

9. The system as claimed in claim 6, wherein the plurality of corresponding fasteners slide within the corresponding elongated hole to accommodate the differential thermal growth of the full span flap, the outer cylindrical surface, and the inner cylindrical surface.

10. The system as claimed in claim 6, wherein the first plurality of elongated holes enable correct positioning of the full span flap within the fluid flow path by allowing for vertical adjustability of the full span flap.

11. The system as claimed in claim 6, wherein each fastener protrudes through the corresponding elongated hole of the second plurality of elongated holes and is secured to the inner cylindrical surface or the outer cylindrical surface with a spherical joint, wherein the spherical joint accommodates thermal distortion of the inner cylindrical surface or the outer cylindrical surface such that each fastener is positioned normally to the fluid flow path.

12. A method to minimize flow induced vibration in a gas turbine exhaust system, comprising:

disposing a full span flap between an outer cylindrical surface and an inner cylindrical surface of a fluid flow path; and removably securing the full span flap behind a trailing edge of a tangential strut by coupling the full span flap to the outer cylindrical surface and the inner cylindrical surface using a plurality of flexible attachment brackets, providing the full span flap with a hollow rectangular box shape including two rounded radial edges and two axial edges, wherein the flow path is bounded radially outward by the outer cylindrical surface and bounded radially inward by the inner cylindrical surface, wherein the full span flap is configured to minimize vortex shedding of the fluid flow from the tangential strut, wherein each rounded radial edge extends radially, with respect to the rotor centerline, from the outer cylindrical surface to the inner cylindrical surface, and wherein each axial edge extends axially, with respect to the rotor centerline, along the inner cylindrical surface or the outer cylindrical surface.

13. The method as claimed in claim 12, wherein the two radial edges are rounded to promote a smooth aerodynamic fluid flow.

14. The method as claimed in claim 12, wherein the securing includes inserting a plurality of fasteners through a plurality of corresponding elongated holes within each flexible attachment bracket of the plurality of flexible attachment brackets and securing the plurality of fasteners with a securing means such that a first plurality of fasteners attaches a first flexible attachment bracket of the plurality of flexible attachment brackets to the full span flap and a second plurality of fasteners attaches a second flexible attachment bracket of the plurality of flexible attachment brackets to the outer cylindrical surface or the inner cylindrical surface.

15. The method as claimed in claim 14, wherein each fastener of the plurality of fasteners slide within an elongated hole of the plurality of corresponding elongated holes to accommodate the differential thermal growth of the full span flap, the outer cylindrical surface, and the inner cylindrical surface.

16. The method as claimed in claim 14, wherein a nut plate is positioned on an opposing surface to a surface of the full span flap to which each flexible attachment bracket of the plurality of flexible attachment brackets abuts and/or to an opposing surface to the surface of the inner cylindrical surface or the outer cylindrical surface to which each flexible attachment bracket of the plurality of flexible attachment brackets abuts, wherein a fastener of the plurality of fasteners protrudes through the nut plate, and wherein the securing means abuts the nut plate and secures the fastener to the nut plate.

17. The method as claimed in claim 16, wherein the securing includes disposing a spherical joint on the opposing surface of the outer cylindrical surface or the inner cylindrical surface through which the fastener protrudes, wherein the spherical joint is used to accommodate for distortion in the flow path such that each fastener is positioned normally to the fluid flow path.

18. The method as claimed in claim 16, comprising welding the nut plate to the opposing surface and the securing means to the nut plate.

* * * * *